US012435888B1

(12) United States Patent
Lewis

(10) Patent No.: US 12,435,888 B1
(45) Date of Patent: Oct. 7, 2025

(54) PORTABLE AIR CONDITIONER

(71) Applicant: Marvin Lewis, Coral Springs, FL (US)

(72) Inventor: Marvin Lewis, Coral Springs, FL (US)

( * ) Notice: Subject to any disclaimer, the term of this patent is extended or adjusted under 35 U.S.C. 154(b) by 56 days.

(21) Appl. No.: 18/381,788

(22) Filed: Oct. 19, 2023

(51) Int. Cl.
*F24F 5/00* (2006.01)

(52) U.S. Cl.
CPC ..... *F24F 5/0017* (2013.01)

(58) Field of Classification Search
CPC .. F25D 3/02; F25D 3/08; F24F 1/0314; F24F 2221/17; F24F 5/0017
See application file for complete search history.

(56) References Cited

U.S. PATENT DOCUMENTS 2,096,553 A * 10/1937 Kucher ..... F24F 5/0017 D23/351
2,202,954 A * 6/1940 Lager ..... F25D 3/06 62/425
7,266,965 B2 9/2007 Blackstone
8,776,789 B2 7/2014 McCabe
10,690,359 B2 * 6/2020 McDonald et al. ... A45C 11/20
12,061,037 B1 * 8/2024 Brinkman ..... F24F 6/14
2018/0015938 A1 * 1/2018 DeFrancia ..... B65D 25/04

* cited by examiner

*Primary Examiner* — David J Teitelbaum
(74) *Attorney, Agent, or Firm* — Sanchelima & Associates, P.A.; Jesus Sanchelima; Christian Sanchelima

(57) ABSTRACT

A portable air conditioner including a housing assembly and a lid assembly. The housing assembly includes housing. The lid assembly includes a lid. The housing has a rectangular shape and is hollow defining an inner cavity suitable to store ice therein. The housing has at least one opening in a front wall thereof. The lid has a fan attached therein. The fan provides an air flow into the housing, the temperature of the air flow is reduced into the housing. The air flow is expelled through the at least one opening. The lid is detachable coupled to the housing defining an open configuration and an open configuration. When the fan is actuated the present invention expels cool air.

1 Claim, 3 Drawing Sheets

PORTABLE AIR CONDITIONER

BACKGROUND OF THE INVENTION

1. Field of the Invention

The present invention relates to a portable air conditioner and, more particularly, to a portable air conditioner that can be installed in different environments to cool a closed area.

2. Description of the Related Art

Several designs for air conditioners have been designed in the past. None of them, however, include attaching means to attach the present invention to a plurality of surfaces.

Applicant believes that a related reference corresponds to U.S. Pat. No. 8,776,789 issued for a portable, low maintenance apparatus for providing cooling air. Applicant believes that another related reference corresponds to U.S. Pat. No. 7,266,965 issued for an air cooling device. None of these references, however, teach of a portable air conditioner comprising a container having an insulated liner, a pair of vents, and a top with a fan.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a portable air conditioner that includes a housing capable of receiving ice cubes therein.

It is another object of this invention to provide a portable air conditioner that includes a housing made of an insulating material.

It is still another object of the present invention to provide a portable air conditioner that includes a motor which rotates a fan to distribute the cool from the housing.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
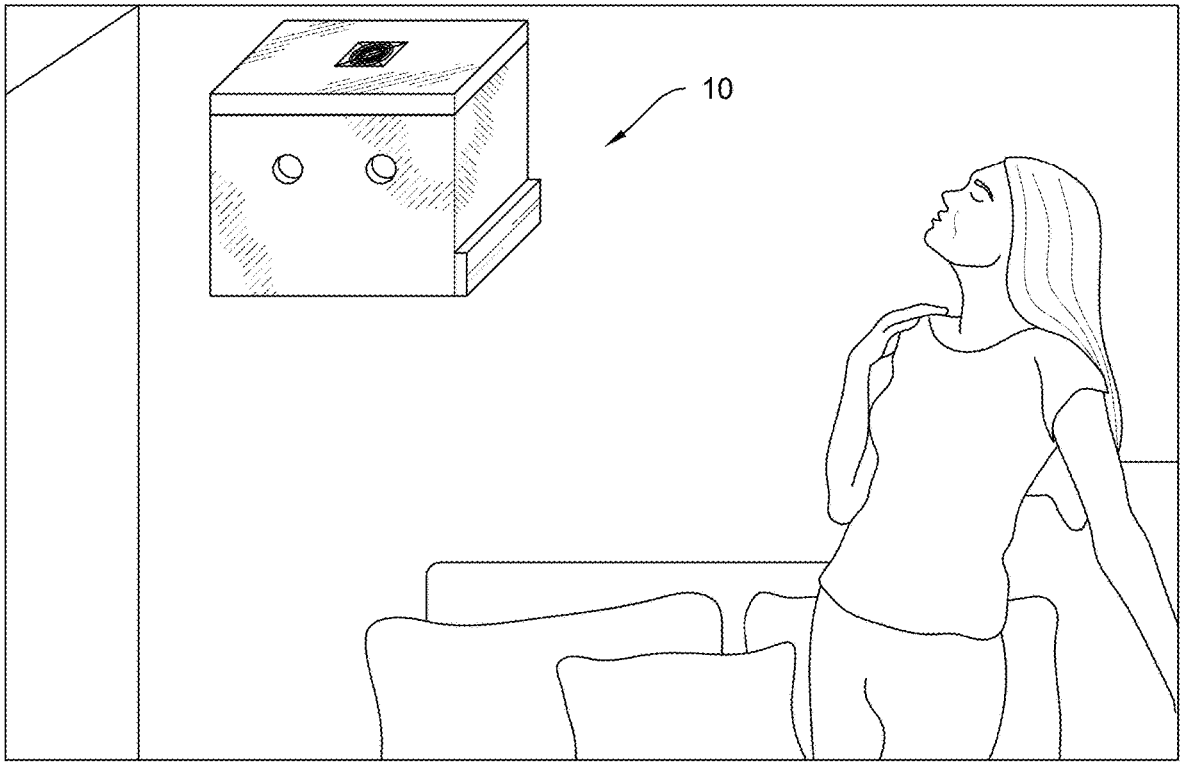
FIG. 1 represents an isometric operational view of the present invention 10.

Referring now to the drawings, where the present invention is generally referred to with numeral 10, it can be observed that it basically includes a housing assembly 20 and a lid assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
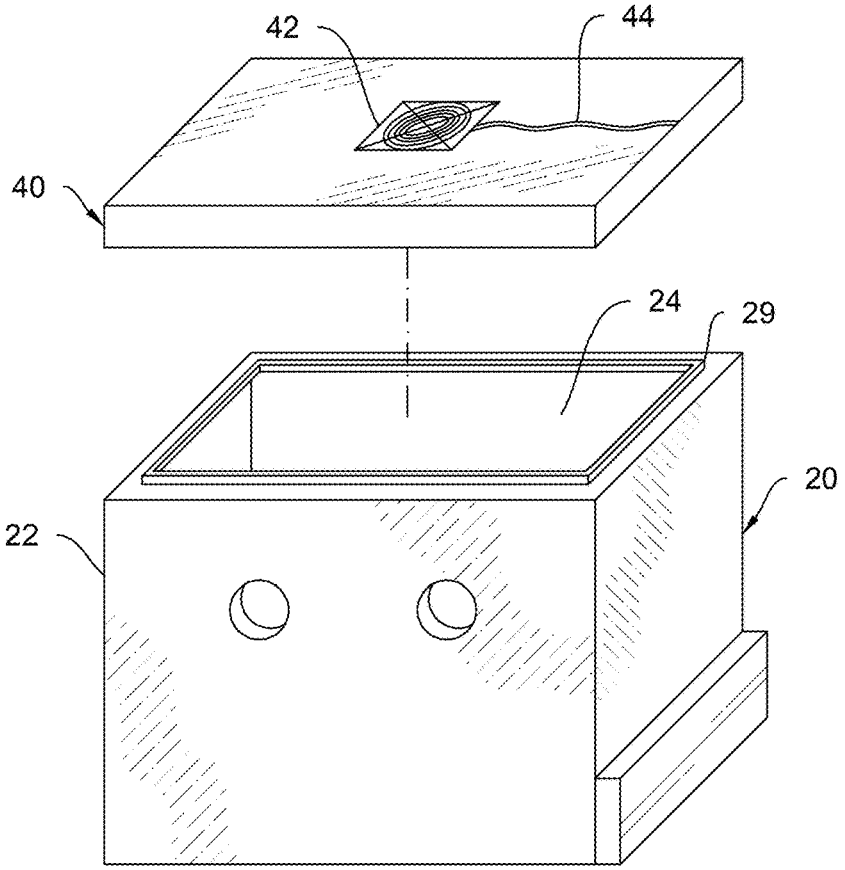
FIG. 2 shows an exploded view of the present invention 10. The present invention 10 may include a housing assembly 20 and a lid assembly 40.

Best illustrated in FIG. 2 the housing assembly 20 may include a housing 22, a lining member 29 and attaching members 27. In a preferred embodiment the housing 22 may have a rectangular shape. It also may be suitable for the housing 22 to have a cylindrical shape, a triangular shape, or any other suitable shape. The housing 22 may have a bottom wall, a left wall, a right wall, a front wall and a right wall and an open top. The housing 22 may be hollow, defining an inner reservoir 24. Outer of the housing 22 may be made of polyvinyl chloride, polyurethane, metal or any other resistant material. Interior of the housing 22 may be made of polystyrene, rock wool, or any other insulating material. The housing 22 may be adapted to receive ice therein.

The housing 22 may have at least one opening 21 in a top portion of the front wall thereof. It also may be suitable for the at least one opening 21 to have any other configuration in the housing 22. In a preferred embodiment the at least one opening 21 may have a circular shape. It also may be suitable for the at least one opening 21 to have a rectangular shape, a triangular shape, or any other suitable shape.

The lining member 29 may be located at a top edge of the open edge of the housing 22. In a preferred embodiment the lining member 29 may be made of rubber plastic. It also may be suitable for the lining member 29 to be made of fiberglass, polyurethane, or any other suitable material. The lining member 29 may adapt to the shape of the edges of the housing 22.

The housing 22 may have the attaching members 27 on the rear wall thereof. The attaching members 27 may be metallic members having an opening suitable to hook with different elements so the housing 22 can be attached to predetermined surfaces.

Figure 3:
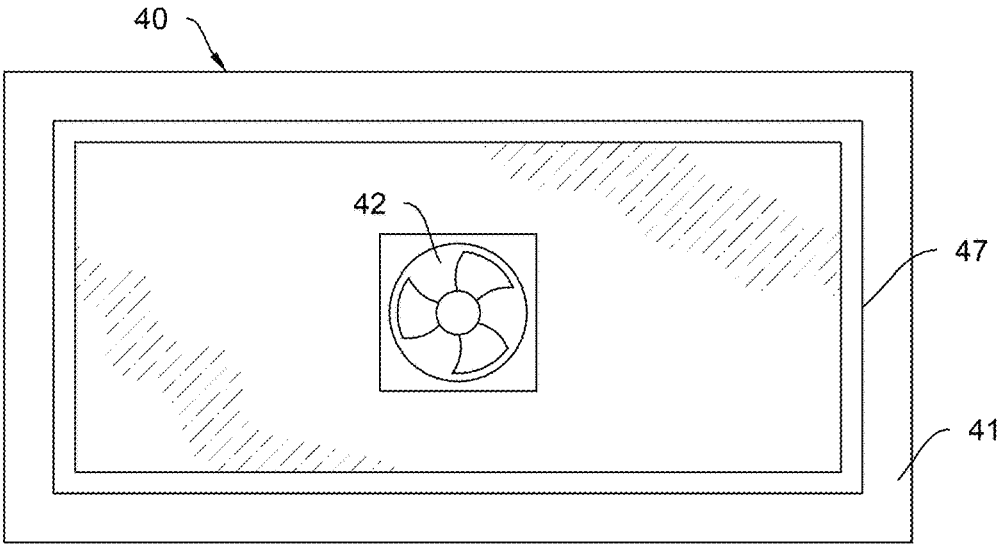
FIG. 3 illustrates a bottom enlarged view of the lid assembly 40.
Figure 4:
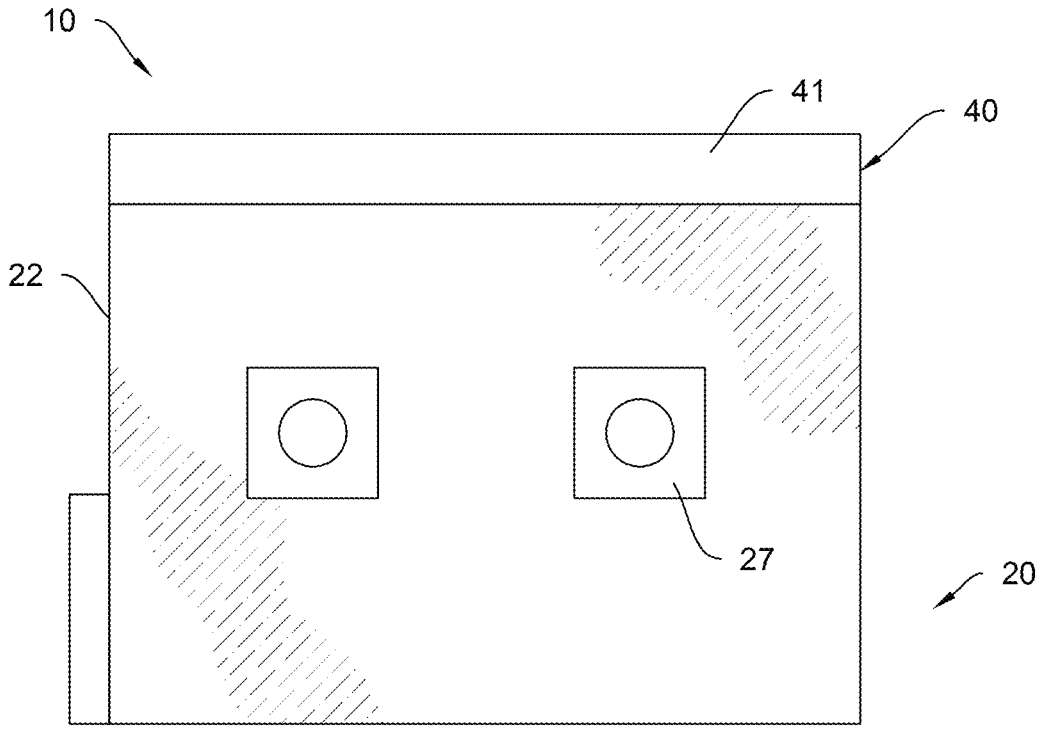
FIG. 4 is a representation of a rear view of the present invention 10 showing the attaching members 27.

Referring now to FIG. 3 it can be observed that the lid assembly 40 may include a lid 41, at least one fan 42, a power cord 44 and a lining portion 47. The lid 41 may have a rectangular shape which cooperates to attach to the top end of the housing 22. The lid 41 may be made of polystyrene, rock wool, or any other insulating material. The lid 41 may include a right wall, a left wall, a front wall, a top wall, a rear wall and a bottom end defining an open bottom portion. The lid 41 may close the housing 42. When closed, outer walls of the lid 41 may flush with outer walls of the housing 22.

The lining portion 47 may be a rubber plastic strip attached to bottom inner edges of the bottom end of the lid 41. The lining portion 47 may be in abutting contact with the lining member 29 to tightly close the housing 22. It also may be suitable for the lining portion 47 to be made of polyurethane, plastic fiber, fabrics or any other suitable material. The lining portion 47 may preferably define a rectangular frame.

The at least one fan 42 may be installed in a central portion of the top wall of the lid 41. The at last one fan 42 may be an air conditioning fan. It also may be suitable for the at least one fan 42 to have any other configuration in the lid 41. The at least one fan 42 may cooperate to increase air flow from outer of the housing 22 thereinto. It should be understood that multiple of the at least one fan 42 may be installed in the lid 41. In a preferred embodiment the at least one fan 42 may be powered by connecting the power cord 44 to a power source. It also may be suitable for the at least one fan 42 to include rechargeable batteries.

In a preferred embodiment user may deposit ice into the housing 22 and actuate the at least one fan 42 to rotate. The at least one fan 42 may increase air flow from out of the housing 22 into the housing 22. The at least one opening 21 may expel the air flow having a decreased temperature.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable air conditioner, consisting of:

a housing assembly, wherein said housing assembly includes a housing, said housing having a rectangular shape, said housing being hollow defining an inner cavity suitable to store ice therein, said housing has at least one opening in a front wall thereof, wherein said housing includes attaching members, said attaching members are fixed to a rear wall thereof, wherein said housing includes a lining member, said lining member is attached to inner edges of a top end of the housing; and a lid assembly, wherein said lid assembly includes a lid, said lid having a fan attached therein, said at least one fan is located on a central portion of a the top wall of the lid, wherein said fan is adapted to provide an air flow into the housing, wherein said temperature of said air flow is reduced into said housing, said air flow is configured to be expelled through said at least one opening, wherein said lid is detachable coupled to said housing defining a closed configuration and an open configuration, wherein side walls of said housing are flush with side walls of said lid in said closed configuration, wherein said lid includes a lining portion, said lining portion is attached to inner edges of a top end of said lid, wherein said lining portion and said lining member are in abutting contact in said closed configuration, wherein said lining portion and said lining member are made of rubber plastic.

* * * * *